United States Patent [19]

Browning

[11] Patent Number: 4,836,447

[45] Date of Patent: Jun. 6, 1989

[54] DUCT-STABILIZED FLAME-SPRAY METHOD AND APPARATUS

[76] Inventor: James A. Browning, P.O. Box 6, Hanover, N.H. 03755

[21] Appl. No.: 144,345

[22] Filed: Jan. 15, 1988

[51] Int. Cl.[4] ..... B05B 7/20

[52] U.S. Cl. ..... 239/8; 239/13; 239/85; 219/121.47; 427/423

[58] Field of Search ..... 239/8, 13, 79–81, 239/85; 427/423; 219/121 PL, 76.16

[56] References Cited

U.S. PATENT DOCUMENTS

| | | | |
|---|---|---|---|
| 2,990,653 | 7/1961 | Browning . | |
| 4,370,538 | 1/1983 | Browning | 239/81 X |
| 4,416,421 | 11/1983 | Browning | 239/79 |
| 4,634,611 | 1/1987 | Browning | 239/81 X |

FOREIGN PATENT DOCUMENTS 0163776 12/1985 European Pat. Off. .

*Primary Examiner*—Andres Kashnikow
*Attorney, Agent, or Firm*—Sughrue, Mion, Zinn, Macpeak & Seas

[57] ABSTRACT

A flame-spray duct defined by the portion of a bore passing through a flame-spray body at the outlet end thereof having a duct L/D ratio of at least 5-to-1 is associated with elements within the flame-spray body which assure nearly uniform flow of reactant oxidant and fuel mixture at the point of introduction of the particulate material within the duct to eliminate the formation of eddies and recirculation regions thereby preventing uninterrupted even flow of the particulate material from the point of introduction into the duct to the exit from the duct resulting in even heating of the particulate material and where the material is capable of melting, the adherence of molten particulate material on the wall of the duct. The elements within the flame-spray body may take the form of a relatively small diameter oxidizer inlet bore leading to a diverging conical diffuser leading to and emerging with a larger diameter bore section defining the flame-spray duct. Alternatively, the metered flow of oxidant may be passed through a plenum chamber to smooth out the flow of oxidizer prior to its introduction into the flame-spray duct and contact with the particulate material. Uniform flow may further be assured by passing the metered flow of oxidant through a long pipe section of uniform diameter prior to introducing the flow of oxidant into the flame-spray duct.

10 Claims, 1 Drawing Sheet

DUCT-STABILIZED FLAME-SPRAY METHOD AND APPARATUS

FIELD OF THE INVENTION

This invention relates to duct-stabilized flame-spray method and apparatus and more particularly, to a method and apparatus for solving the problem of overheating powder particles subject to uneven gas flow regimes through the flame duct.

BACKGROUND OF THE INVENTION

Flame spray apparatus has been employed for melting powder particles in effecting the build-up of molten material on a substrate downstream of the discharge and of the flame-spray duct. Additionally, such flame-spray apparatus modified or unmodified has been employed in accelerating small abrasion particles in the flame-spray at high velocity, sonic or supersonic, with the particles ejected at high speed from the discharge and of the flame-spray apparatus to impact a workpiece positioned in the path of particle flow. Internal burner type supersonic flame-spray apparatus of this type is exemplified by my U.S. Pat. No. 2,990,653 issued July 4, 1961; 4,370,538 issued Jan. 25, 1983; and U.S. Pat. No. 4,416,421 issued Nov. 22, 1983.

By the utilization of an expansion nozzle of extended length, products of combustion from an internal burner to which an oxy-fuel mixture is continuously fed and combusted, with combustion effected under substantially high pressure and with the products of combustion directed through a flow expansion nozzle, the creation of a flame-spray stream of supersonic velocity is achieved. Aspects of these patents include the mode of introduction of solid material in either rod form or particle form into the flame-spray and an attempt to insure a concentrated and highly focused core of flame-spray material for material spray coating downstream of the nozzle at supersonic velocity, or alternatively, the spraying of abrasive solid particles for sandblasting of a workpiece positioned in front of the nozzle exit port.

My published European patent application No. 0 163 776, published Nov. 12, 1985, is directed to such supersonic flame-spray apparatus utilizing an internal burner which continuously feeds oxy-fuel products of combustion through an extended length nozzle of diminished throat area and a supersonic expansion duct 15 upstream of an extended length nozzle passage 16, 36. The expansion of the hot products of combustion from the throat 14, 35 to the end of the expansion duct 15 provides a gas velocity well in excess of supersonic. In this supersonic flame apparatus, solid material in rod or particle form is introduced axially or radially into the supersonic gas flow at the end of the expansion duct 15 and allows the extended length nozzle passage to have a relatively large diameter tending to prevent solid material introduced to the flow to melt, reach the nozzle passage wall and adhere there to or, where abrasive particles form that solid material, abrade the nozzle wall. Additionally, the material injection can be achieved at low pressure, since the hot products of combustion are at significantly reduced diameter but supersonic velocity at the discharge end of the expansion duct 15.

While the present invention is directed to a duct stabilized cold gas flame-spray method and apparatus, certain aspects of internal burner supersonic flame-spray apparatus of the type described above, include common problems and employ structural elements necessary to cold gas flame-spray apparatus.

The lessons learned from the developments in the internal burner supersonic flame-spray apparatus form a background and have led to an understanding and appreciation of problems common to both hot gas supersonic and cold gas duct-stabilized flame-spray method and apparatus and have led to the improvement within the duct-stabilized cold gas flame-spray method and apparatus forming the invention.

In that regard, attempts to use satisfactory duct-stabilized flame-spray apparatus have been unsuccessful to date without the use of complex geometries. The main difficulty has been found to lie in the overheating of powder particles when using uneven gas flow regimes. Recirculation of the particles within the flame occur. The smaller particles may melt causing the build-up of adhering masses of material against the nozzle and flame passage walls.

It is therefore a primary object of the present invention to provide an improved duct stabilized cold gas flame-spray method and apparatus for flame spraying molten material on a substrate or flame spraying abrasion particles against the workpiece for surface blasting of the same, and which achieves even gas flow regimes at the point of introduction of solid material in power particle form into the flame-spray and during flow downstream thereof through the flame-spray duct.

DESCRIPTION OF THE PREFERRED EMBODIMENTS

Figure 1:
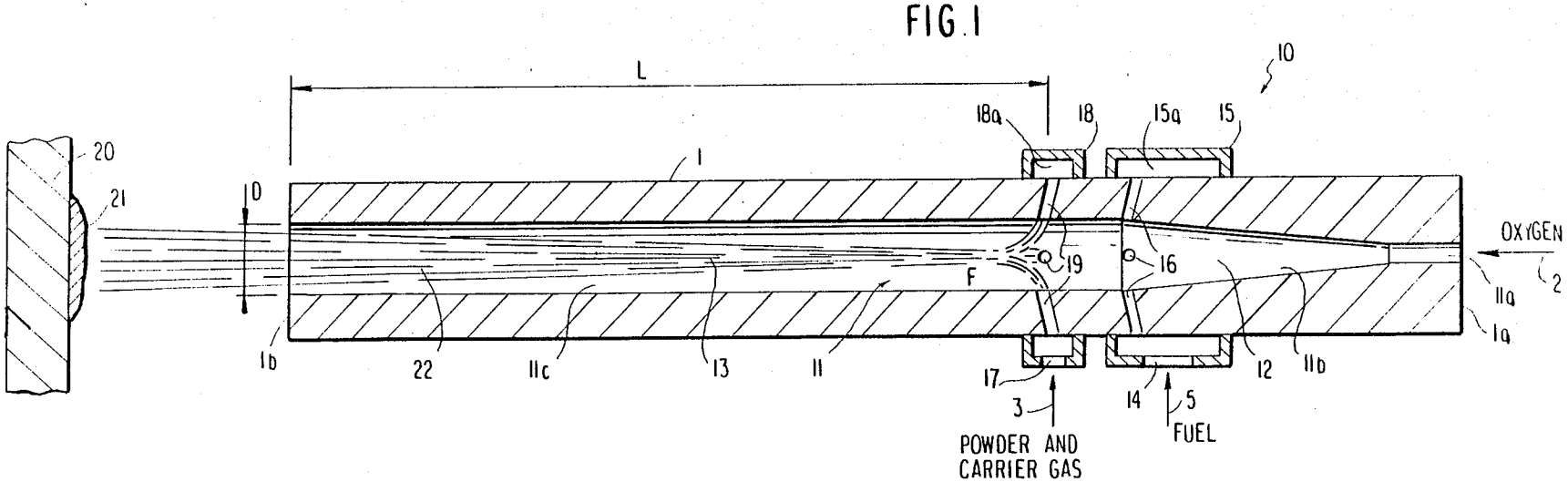
FIG. 1 is a longitudinal cross-sectional schematic view of a duct-stabilized flame-spray device forming a first embodiment of the invention.
Figure 2:
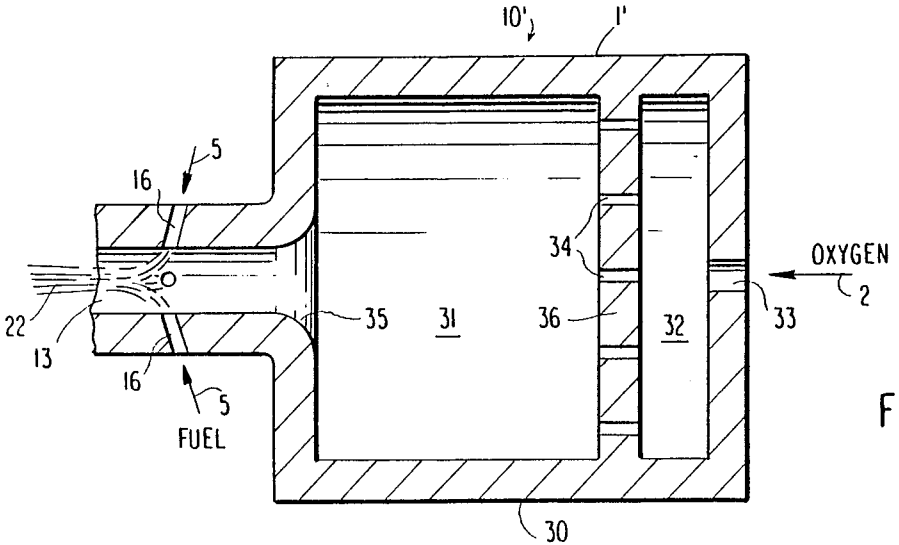
FIG. 2 is a longitudinal cross-sectional schematic view of a portion of a duct-stabilized flame-spray device forming a second embodiment of the invention.

With respect to the two embodiments of the invention depicted in FIGS. 1 and 2, an effort has been made to simplify the schematic representations as well as the accompanying description within the specification and the water coolant passages normal to such apparatus have been omitted as well as automatic spark-ignition and gas flow control systems which are similar if not identical to those within my patents and published European application discussed above and the content of those references are incorporated herein by reference. Simply stated, this invention resides in a method and means for developing an essentially uniform gas flow within the flame duct prior to the introduction of powder particles to the gas flow, thereby preventing recirculation of the particles within the flame and the attendant abrasion of the duct wall or melt particle build-up thereon. The invention both in terms of process and apparatus is characterized by having all flow trajectories passing in parallel through the duct bore and the elimination of regimes of flow recirculation, and thus recirculation of particles as a result of an obstacle, sharp edge, or sudden change in duct diameter over the length of the duct bore within which the particles flow after introduction of the gas flow stream.

Turning to FIG. 1, a duct-stabilized flame-spray device 10 forming a first embodiment of the invention is shown as consisting of a flame spray body or metal tube 1 having an axial hollow bore or through passage 11 including a small diameter bore portion 11*a* at the inlet 1*a* of the spray device 10, a conical bore portion 11*b* which expands towards outlet end 1*b* of the spray device and a further downstream constant diameter bore portion 11*c* of relatively large diameter and of extended length. Bore portion 11*b* forms a diffuser 12 leading to the large constant diameter portion 11*c* of the bore. A cold gas such as oxygen as indicated by arrow 2 is supplied under pressure to the small diameter bore portion 11*a* at inlet end 1*a* of tube 1, moving through diffuser 12 and through the flame-spray duct 13 in the direction of workpiece 20 which is positioned at right angles to the axis of tube 1 and spaced downstream thereof. In the illustrated embodiment, the workpiece is subject to flame coating, with the material build-up indicated at 21 on the surface of the workpiece 20 facing the flame-spray duct 13.

An appropriate fuel, usually a gas such as acetylene, propylene, or propane is introduced into bore 11 at the downstream end of the diffuser 12 defined by the conical expanding bore portion 11*b* entering the interior of the bore 11 via one or more radial or oblique holes 16. A manifold piece 15 of annular form surrounds the tube 1 to form a manifold chamber 15*a*, the chamber 15*a* being fed with fuel under pressure as indicated by arrow 5 through radial port 14 within the annular manifold piece 15. The fuel mixes with the incoming cold oxygen tube and ignition of the combustible gas mixture formed thereby occurs within flame-spray duct 13 at the upstream end of duct 13 and at the downstream end of diffuser 12. Ignition of the combustible mixture within the flame-spray duct 13 may be effected by a spark-plug or by flashback down duct 13 from an exterior ignition source positioned adjacent the exit end 1*b* of the flame-spray body or tube 1. Such is a hand-operated "spark lighter". Given a proper inner duct wall diameter for flame-spray duct 13 and proper oxygen and fuel flows 2, 5, an intense flame region fills flame-spray duct 13. Under high-flow, choked conditions, sonic exit velocities exist at the duct exit, and at even higher flow pressures, free-expansion of the flame in the atmosphere can lead to supersonic jet velocities of the expanding cone 22 beyond exit end 1*b* of the flame-spray body 1.

Metal, ceramic, or other powder supported by a carrier gas, is introduced bore or hole 17 of a second annular manifold 18 as indicated by arrow 3, with the powder and carrier gas passing from the manifold chamber 18*a* through one or more injection holes 19 into the interior of the flame-spray duct 13, defined by bore section 11*c*. The powder flow F possesses a strong radial component relative to the oxygen-fuel axially through bore or passage 11. Each powder particle (for a nearly uniform particle size distribution) is accelerated to high velocity in a uniform manner and heated nearly equally prior to exiting from the flame-spray body 1. As the "flame" gases do not recirculate, the particles travel in a single direction down duct 13, but within the expanding cone or core 22. First, in the embodiment of FIG. 1 heating results in softening of the particles. Stray particles (either solid or heat softened) may strike the inner flame-spray duct 13, wall, but they are merely deflected back into the stream 22. The path length L of the powder flow F along the flame-spray duct 13 must be kept less than that resulting in actual melting of the particles. Without the presence of devious particle paths, the particles all reach the exit of flame-spray duct 13 in the same unmolten state. Beyond the duct exit, they are further heated and accelerated. When they impinge against the workpiece 20, a coating 21 is formed, which upon cooling solidifies into the mass 21 as illustrated in FIG. 1.

The purpose of the expanding diffuser section 12 is to provide an even flow of the oxygen (or oxygen and fuel) if the latter is introduced upstream of the expanding diffuser section 12 when passing from the relatively small diameter inlet passage 11 to the flame-spray duct 13. The interior wall of both the diffuser 12 and that of flame-spray duct 13 must be smooth to help attain the required even flow. Purposely, in the embodiment of FIG. 1, the flame-spray steam 22 of conical form at the exit end 1*b* of the flame-spray body 1 is of a diameter which is less than the diameter D of the flame-spray duct 13.

The invention envisions the substitution of means for evening out the cold gas flow passing into the flame-spray duct 13, for instance in place of the expanding diffuser section 12, a plenum chamber may be employed or alternatively, a long constant diameter pipe section may be employed upstream of the flame-spray duct 13 to insure uniform gas flow.

Turning to FIG. 2, that Figure illustrates a second embodiment of the flame-spray apparatus 10' in which like elements have like numerical designations of the embodiment of FIG. 1. Instead of diffuser 12, oxygen is introduced under pressure through a inlet or supply hole 33 within a vertical end wall of a radially enlarged cylindrical portion 30 of flame-spray body 1', the oxygen being indicated by arrow 2 and passing into a chamber 32. A transverse wall 36 separates chamber 32 from a further plenum chamber 31 which wall includes a series of small diameter holes 34 permitting the oxygen under pressure to pass into plenum chamber 31 which is of relatively large volume. A porous solid could form wall 36 as long as it is capable of passing the cold gas flow under some pressure and performing, with the plenum chamber, the function of evening out the flow of the cold gas to the flame-spray duct 13. The axial flow rate is greatly reduced by the plenum chamber and the flow regime in chamber 31 is nearly uniform. The oxygen then passes over the smooth wall of the bore entry 35 into flame-spray duct 13, the balance of the flame-spray body 1 being the same as that as shown in FIG. 1. Thus, the flow of the oxygen and the flame-spray stream formed by the combustion of fuel 5 entering through oblique ports 16 into the flame-spray duct 13, mixing with the oxygen and being combusted in the manner of the first embodiment, creates a conical flame-spray stream 22 of similar shape, with the cone being a diameter smaller than that of the flame-spray duct 13 and insuring the passage of powder and carrier gas particles entering the flame-spray stream via a series of ports of holes 19 fed by a powder and carrier gas in the same manner as that indicated by arrow 3, FIG. 1. Again, the cold gas flow and the combustion gases created by the flame constitutes a uniform axial flow within duct 13 without the presence of recirculating flow (eddies) tending to cause the particles to melt, particularly the smaller particles, and attach and plug up the interior of the passage section 11*c*, while the fuel air mixture has been described in terms of pure oxygen and fuel at 2, 5, in each instance, other oxidizers such as compressed air or oxygen enriched air may be substituted. The main consideration and necessity in both the embodiments of FIGS. 1 and 2 is to provide an essentially uniform gas flow through the flame-spray duct 13, to introduce particles to be sprayed at a point along the duct where the flow is of adequate uniformity and maintaining a length L for the flame-spray duct 13 which is only that which precludes the particles melting prior to exiting from the flame-spray duct 13.

Exemplary for the apparatus 10 of FIG. 1, such apparatus includes a flame-spray duct 13 of a diameter D of 7/16 of an inch and having a effective length L of 8 inches employable for spraying of high melting point ceramic, chromium oxide onto substrate 20 to form the built-up 21. In this embodiment, the diffuser section 12 is of 1 inch in length and having an inlet passage or bore section 11*a* of a diameter of 3/16 of an inch. Oxygen, at a flow rate of approximately 600 SCFH was used with the combustion fuel consisting of acetylene gas. A 0.015 inch coating 21 of the chromium oxide ceramic was quickly and readily deposited on workpiece 20, with the workpiece being held approximately 12 inches away from the exit end 1*b* of the flame-spray duct 13. The coating 21 realized, possessed a Vicker's hardness of 1,390; an exceptionally high and desirable value. For the embodiment of FIG. 1 and the example given, the L/D ratio was 18-to-1. For lower melting point materials forming the powder introduced into the stream, lower L/D ratios must be used, otherwise material will deposite on the interior walls of the flame-spray duct 13.

In practicing the method of the present invention it is necessary that the apparatus as illustrated in FIGS. 1 and 2 include means for reducing the velocity of the cold gas flow stream entering the relatively small diameter inlet passage 11, 33 at the upstream end of the flame-spray body 1, 1', the effect of which is to achieve even flow over the complete cross section of the flow passage at the upstream end of the flame-spray duct 13, where fuel and air mixes, combustion is effected and upstream of the entry point for the powder and carrier gas, irrespective of the nature of the powder particles, i.e. whether they are to be rendered molten in the flame-spray for coating of a substrate, or simply accelerated for surface abrasion of a workpiece substituted for the substrate 20, FIG. 1, the method of rendering the flow of the cold gas even at the upstream end of the flame spray duct is achieved in the illustrated embodiments by an expansion section 12 of conical form whose diameter enlarges from the diameter of the inlet section 11*a* to the relatively large diameter of the flame-spray duct passage section 11*c*.

As mentioned previously, although flame-spray coating is effectively enhanced by employing the present invention, the same principles and improvements apply to the same or closely similar apparatus applied to grit-carrying systems for sandblasting or like abrading. The apparatus of FIG. 1 using the same 7/16 inch diameter nozzle was used with a pressured introduction of silica grit of a size sufficiently large, not to be over-heated during its passage through the nozzle flame-spray duct 13 as defined by flame-spray body 1. A badly rusted steel plate was quickly cleaned, with the particles introduced into the flame-spray duct 13 at low velocity. The particles were accelerated to high speed with little impact against the soft copper wall of the nozzle body 1. In the example run, which was 2 minutes long, no wear of the copper flame-spray body 1 took place.

Importantly, the ability to grit blast a surface with the same device that is employed to flame coat that cleaned surface, leads to important advantages. Typically, a part to be flame-sprayed is grit blasted in a separate operation and hours, days, or months may go by before the coating is applied to the grit blasted surface. Thus, the once clean surface rapidly becomes oxidized and may be even coated by dirt, oil, which are always present in a machine shop environment. using the same device to blast-clean the surface of the workpiece and then flame-spray that clean surface, eliminates double handling and provides sufficient heat to the part to preclude the presence of moisture on the surface to the sprayed. As a result, higher coating-to-surface bond strengths occur.

What is claimed is:

1. In a duct-stabilized flame spray method comprising the steps of feeding a metered flow of a cold fluid oxidant and a fuel into a duct in a flame spray body, mixing the oxidant and the fuel, igniting the flow mixture of said oxidant and fuel to maintain a combustion region within, through, and out of sad duct to thereby form a high-velocity, high temperature jet stream extending beyond the exit of the duct in the direction of a workpiece in the path of said jet stream, introducing particulate material to the jet stream at or near the upstream entrance to said duct, and directing the high-velocity particles against said workpiece, the improvement comprising the step of assuring nearly uniform flow of reactant oxidant and fuel mixture at the point of introduction of the particulate material into said duct by having a duct L/D ratio of at least 5-to-1 and by radially introducing the particulate material such that the nearly uniform flow of reactant oxidant and fuel mixture at the point of radial introduction of the particulate material eliminates the formatiion of eddies and recirculation regions preventing uninterrupted, even flow of the particulate material from the point of introduction to the exit end of the duct, and thereby preventing uneven heating of the particulate material.

2. The method as claimed in claim 1, wherein the step of assuring nearly uniform flow of the reactant oxidant and fuel mixture at the point of introduction of the particulate material comprises passing said metered flow of cold fluid oxidant through a conical diffuser leading from a relatively small diameter oxidizer inlet bore to said duct which has a larger diameter than said inlet bore.

3. The method as claimed in claim 1, wherein said step of assuring nearly uniform flow of the reactant oxidant and fuel mixture at the point of introduction of the particulate material comprises passing said metered flow of oxidant through a plenum chamber to smooth out the flow of the oxidizer prior to its introduction into said duct.

4. The method as claimed in claim 1, wherein said step of assuring nearly uniform flow of the reactant oxidant and fuel mixture at the point of introduction of the particulate material comprises passing said metered flow of oxidant through a long pipe section of uniform diameter prior to introducing the flow of oxidant into said duct.

5. The method as claimed in claim 1, wherein said step of metering flows of an oxidant and fuel into said duct and igniting a flow mixture of the oxidant and fuel comprises maintaining a value of L/D for said duct sufficiently large to produce a high-velocity flow of the particulate material, yet not so large as to cause the adherence of molten material on the internal duct wall of the flame-spray body.

6. A flame-spray apparatus comprising a flame-spray body, a bore extending through said flame-spray body, said bore including an inlet end thereof to an outlet end thereof, means for feeding a metered flow of a cold fluid oxidant and a fuel into said flame-spray body bore, mixing the oxidant and fuel, igniting the fuel mixture of the oxidant and fuel to maintain a combustion region within, through and out of said bore to thereby form a high-velocity, high temperature jet stream extending beyond the exit of the bore in the direction of a workpiece in the path of said jet stream, means for introducing particulate material to the jet stream at or near the upstream entrance to the bore and directing the high-velocity particles against said workpiece, the improvement comprising means for assuring nearly uniform flow of reactant oxidant and fuel mixture at the point of introduction of the particulate material and means for radially introducing the particulate material within a flame-spray duct defined by a portion of said bore having a duct L/D ratio of at least 5-to-1 such that the nearly uniform flow of reactant oxidant and fuel mixture at the point of radial introduction of the particulate material eliminates the formation of eddies and recirculation regions preventing uninterrupted, even flow of the particulate material from the point of introduction to the exit of the bore and thereby preventing uneven heating of the particulate material.

7. The flame-spray apparatus as claimed in claim 6, wherein said bore comprises in order from the bore inlet end to the bore outlet end, a relatively small diameter oxidizer inlet bore section, a diverging conical diffuser and a relatively large, constant diameter bore section defining said flame-spray duct.

8. The flame-spray apparatus as claimed in claim 6, wherein said means for assuring nearly uniform flow of reactant oxidant and fuel mixture at the point of introduction of the particulate material comprises a plenum chamber within said flame-spray body, upstream of the section of said bore defining said flame-spray duct for smoothing out the flow of the oxidizer prior to its introduction into said duct.

9. The flame-spray apparatus as claimed in claim 6, wherein said means for assuring nearly uniform flow of the reactant oxidant and fuel mixture at the point of introduction of the particulate material comprises a long pipe section of uniform diameter upstream of said duct for passing said metering flow of oxidant through said long pipe section of uniform diameter prior to introduction of the flow oxidant into flame-spray duct.

10. The flame-spray apparatus as claimed in claim 6, wherein said L/D ratio for said flame-spray duct is large enough to produce a high-velocity flow of particulate material but below the value capable of causing the adherence of molten particulate material introduced into the products of combustion of said oxidant and fuel to adhere on the internal duct wall of the flame-spray body.

* * * * *